US012251620B2

(12) United States Patent
Martikainen

(10) Patent No.: US 12,251,620 B2
(45) Date of Patent: Mar. 18, 2025

(54) METHOD AND EQUIPMENT FOR PROVIDING A SNOW STORAGE WITH HEAT INSULATION

(71) Applicant: Snow Secure Oy, Leppävirta (FI)

(72) Inventor: Mikko Martikainen, Leppävirta (FI)

(73) Assignee: Snow Secure Oy, Leppävirta (FI)

( * ) Notice: Subject to any disclaimer, the term of this patent is extended or adjusted under 35 U.S.C. 154(b) by 465 days.

(21) Appl. No.: 17/624,961

(22) PCT Filed: Jul. 10, 2019

(86) PCT No.: PCT/FI2019/050541
§ 371 (c)(1),
(2) Date: Jan. 5, 2022

(87) PCT Pub. No.: WO2021/005261
PCT Pub. Date: Jan. 14, 2021

(65) Prior Publication Data

US 2022/0266121 A1 Aug. 25, 2022

(51) Int. Cl.
*A63C 19/10* (2006.01)
*A63C 19/12* (2006.01)
(Continued)

(52) U.S. Cl.
CPC ..... *A63C 19/10* (2013.01); *F25C 3/04* (2013.01); *A63C 19/12* (2013.01); *E01H 4/02* (2013.01)

(58) Field of Classification Search
CPC ..... A63C 19/10; A63C 19/12; F25C 3/04; E01H 4/02; E04B 1/80
(Continued)

(56) References Cited

U.S. PATENT DOCUMENTS 4,413,029 A 11/1983 Handwerker
4,632,329 A * 12/1986 Burley ..... B65H 75/28 242/390.8
(Continued)

FOREIGN PATENT DOCUMENTS

CN 207863196 U 9/2018
DE 202018102906 U1 * 7/2018 ..... A63C 19/10
(Continued)

OTHER PUBLICATIONS

Japanese Patent Office, Notice of Reasons of Refusal, Application No. 2022-502072, mailed Jun. 5, 2023, English Translation, 6 pages.
(Continued)

*Primary Examiner* — Christine T Cajilig
(74) *Attorney, Agent, or Firm* — Ziegler IP Law Group, LLC.

(57) ABSTRACT

A method of providing a snow storage with heat-insulation, the method including covering a snow pile made at a snow storage site with heat-insulating materials of which at least some are insulation boards. In the method, the insulation of the snow pile is carried out by using insulation board mats which include several insulation boards, or insulation board groups consisting of several insulation boards attached against each other, side by side and/or one after another, and which are pivotably joined together, alternately at the upper corners and the lower corners of their opposite transversal end edges, the resulting continuous insulation board mat composed of several insulation boards one after another being foldable into an accordion-like insulation board bundle and re-openable into a continuous insulation board mat. The invention also relates to equipment for providing a snow storage with heat-insulation.

14 Claims, 3 Drawing Sheets

(51) Int. Cl.
*F25C 3/04* (2006.01)
*E01H 4/02* (2006.01)

(58) Field of Classification Search
USPC ..... 52/5
See application file for complete search history.

(56) References Cited

U.S. PATENT DOCUMENTS

| | | | | | |
|---|---|---|---|---|---|
| 4,641,400 | A | | 2/1987 | Moreland | |
| 4,774,777 | A | * | 10/1988 | Brochu | A63C 19/12 37/197 |
| 4,798,220 | A | * | 1/1989 | Smoljo | E04B 1/762 135/900 |
| 2018/0111466 | A1 | * | 4/2018 | Ching | B60J 11/04 |
| 2020/0276491 | A1 | * | 9/2020 | Martikainen | E01H 4/02 |

FOREIGN PATENT DOCUMENTS

| | | | | | |
|---|---|---|---|---|---|
| EP | 0201987 | A1 | * | 11/1986 | |
| EP | 150865 | B1 | | 5/1989 | |
| EP | 3919842 | A4 | * | 12/2021 | A63C 19/10 |
| JP | S61222471 | A | | 10/1986 | |
| JP | H07145675 | A | | 6/1995 | |
| JP | 2002115239 | A | | 4/2002 | |
| JP | 2003207241 | A | | 7/2003 | |
| JP | 2005291605 | A | | 10/2005 | |
| JP | 2011137363 | A | | 7/2011 | |
| JP | 3219140 | U | | 11/2018 | |
| WO | WO-2018083373 | A1 | * | 5/2018 | A63C 19/10 |

OTHER PUBLICATIONS

National Intellectual Property Administration, P.R. China; Search Report, Application No. 201980098352.6, dated Jan. 29, 2023, 3 pages.

European Patent Office, Supplementary European Search Report, Application No. EP19937192, mailed Mar. 15, 2023, 2 pages.

International Preliminary Report on Patentability, Finnish Patent and Registration Office, Application No. PCT/FI2019/050541, mailed Nov. 4, 2021, 21 pages.

International Search Report and Written Opinion, Finnish Patent and Registration Office, Application No. PCT/FI2019/050541, mailed Nov. 1, 2019, 5 pages.

Written Opinion of the International Searching Authority, Finnish Patent and Registration Office, Application No. PCT/FI2019/050541, mailed Nov. 1, 2019, 7 pages.

* cited by examiner

METHOD AND EQUIPMENT FOR PROVIDING A SNOW STORAGE WITH HEAT INSULATION

OBJECT

The aspects of the disclosed embodiments relate to a method and equipment for providing a snow storage with heat insulation.

BACKGROUND

It is becoming more and more common to store snow made for ski slopes or cross-country trails at different kinds of ski and winter sport resorts, as well as for first-snow skiing tracks made by cities, for example, in heat-insulated snow storages over the summer. To preserve the snow over the summer, the snow must be covered with a sufficient amount of appropriate heat-insulating materials since even The Nordic countries may experience outdoor temperatures up to +30° C. during the summer months. Besides, the walls and roof of the snow storage are exposed to a lot of direct sunshine in the summer, and, in rainy weather, the snow storage is wet by rainwater.

The heat-insulation of the snow storage consists of heat-insulators added on top of a snow mass piled up at a desired snow storage site. Of these materials, the following continue to be the most common ones: sawdust, different kinds of clothes, as well as polystyrene and/or polyurethane insulation boards. The applied methods work well in other aspects but, in the step of insulating and dismantling the snow storage, they require a lot of manual labor as well as transporting a variety of heat-insulating materials from their storage site to the snow storage and back, causing high labor and transportation expenses.

BRIEF SUMMARY

The aspects of the disclosed embodiments aim at providing a novel method of heat-insulating a snow storage, making it faster and easier to install and uninstall the heat-insulation of the snow storage and, thus, resulting in lower labor and insulation material handling expenses related to the storage of the snow over the summer. In particular, the aspects of the disclosed embodiment aim at providing a method of simplifying the operations of installing and uninstalling the heat insulation of the snow storage and, thus, resulting in a significant decrease of the high amount of work and expenses currently involved therein. Moreover, the aspects of the disclosed embodiments aim at providing equipment for carrying out the method according to the aspects of the disclosed embodiments.

In the method according to the aspects of the disclosed embodiments at least some of the heat-insulators used for covering the snow pile requiring heat-insulation consist of insulation board mats which are made out of insulating boards joined together in an accordion-like fashion, and, which, as the snow storage is insulated, are pulled to lie side by side and/or one after another on the top/sides of the snow storage, and which, once the snow stored in the snow storage is taken out, are pulled back to lie next to the snow pile, in an accordion-like configuration, where they are stored while the snow stored in the snow storage is being used (i.e. during the skiing season) and from where they are taken back into use when a snow pile intended for the next season's snow supply is stored at the same site. To put it more precisely, the method and equipment according to the aspects of the disclosed embodiments are characterized in what is set forth in the independent claim 1 and in the independent claim 8, respectively. The dependent claims disclose preferred embodiments of the method according to the present disclosure and preferred embodiments of the equipment according to the present disclosure, respectively.

An advantage of the method and equipment according to the aspects of disclosed embodiments is that, as the heat-insulated snow storage is created, they eliminate a slow and laborious step of installing individual insulation boards on the top and sides of the snow pile, and that, as the snow storage is taken into use, they do not have to be individually collected off the snow pile. In addition, as a result of how the heat-insulating materials are stored in the method according to the aspects of the disclosed embodiments, the heat-insulating materials do not have to be transported over long distances to a storage and, then, from the storage back to the proximity of the snow pile to be re-installed on a new snow pile stored over the summer and intended for the needs of the next winter. All these measures facilitate the set-up and use of snow storages by reducing and simplifying the work steps involved in creating the snow storages and in taking them into use, the expenses of the use of the snow stored over the summer thus becoming significantly lower than in the previously known methods.

DESCRIPTION OF THE FIGURES

In the following, the aspects of the disclosed embodiments will be explained in more detail with reference to the accompanying Figures wherein.

DETAILED DESCRIPTION

Figure 1:
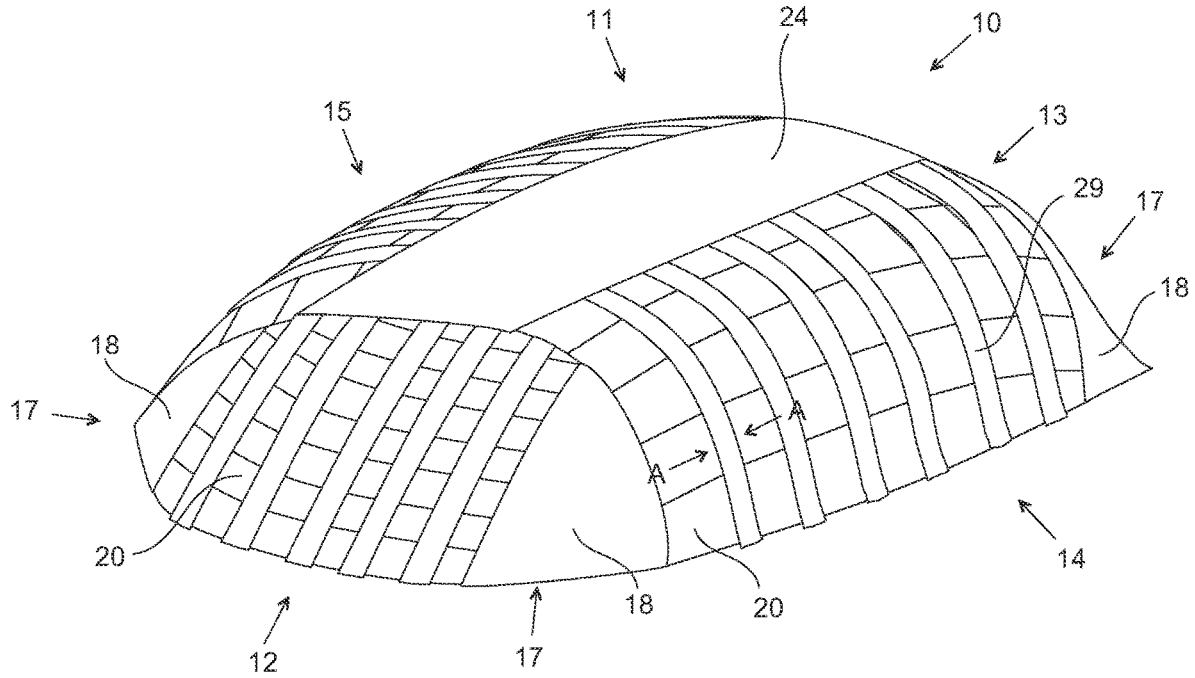
FIG. 1 is an oblique top view of a snow storage created by the method according to the aspects of the disclosed embodiments, while snow is stored there over the summer.

In the snow storage 10 shown in FIG. 1 and heat-insulated by the method according to the aspects of the disclosed embodiments, the heat-insulation of the roof 11, end walls 12 and 13 as well as the lateral walls 14 and 15 parallel to the longer sides is provided by insulation board mats 20 consisting of insulation boards 16 joined together in an accordion-like fashion. Typically, the insulation boards 16 of the insulation board mats 20 are polyurethane, polystyrene or similar insulation boards, for example. Alternatively, the insulation boards 16, or some of them, can be other insulation boards, such as foam rubber or cellular plastic boards. It is possible to select the outer dimensions of the insulation boards 16 of the insulation board mats case by case or to use standard-size insulation boards. The insulation boards 16 must be thick enough to sufficiently acknowledge the climatic conditions prevailing in the location of the snow storage 30.

The corners 17 between the end walls 12 and 13 as well as the lateral walls 14 and 15 of the snow storage 10 shown in FIG. 1 are insulated by triangular corner inserts 18 fitted therein. Herein, the corner inserts 18 are made of an integral piece of an elastic and bendable heat-insulating material, such as a foam rubber or cellular plastic board. The outer dimensions and thickness of the corner inserts 18 may also vary according to the size and heat-insulation requirements of the snow storage. In an embodiment of the method and equipment according to the present disclosure, the corners 17, and therefore, the end walls 12 and 13 of the snow storage as well, can also be insulated by means of inner walls made out of snow and/or ice, for example, as well as by means of a heat-insulating layer provided on the inner walls by using sawdust and/or pykrete, i.e. frozen sawdust, accumulated thereon.

Figure 3:
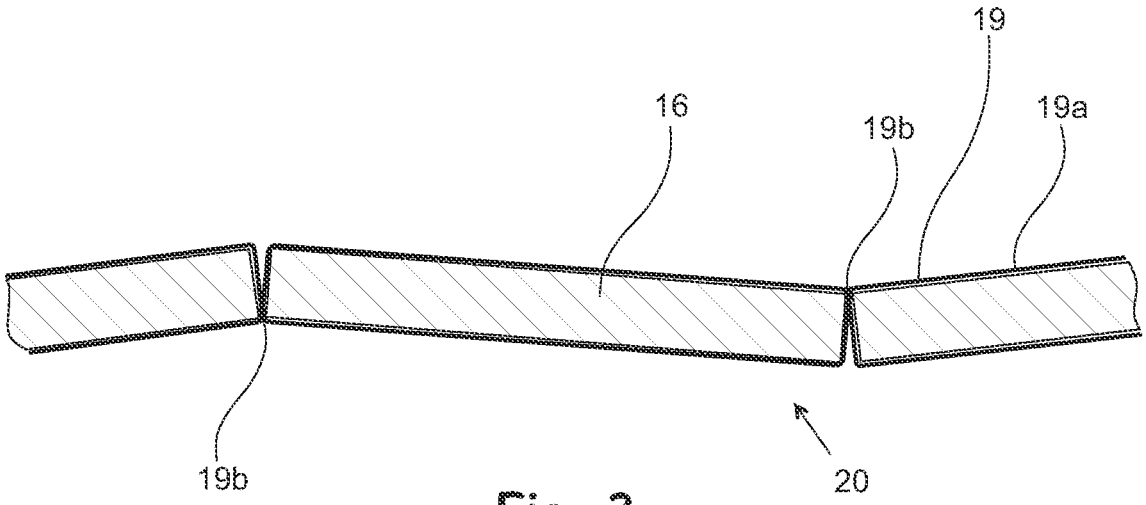
FIG. 3 is a longitudinal cross-sectional view of a heat-insulation board mat used as an heat-insulation on the roof, end walls and lateral walls of the snow storage of the above Figures.
Figure 4:
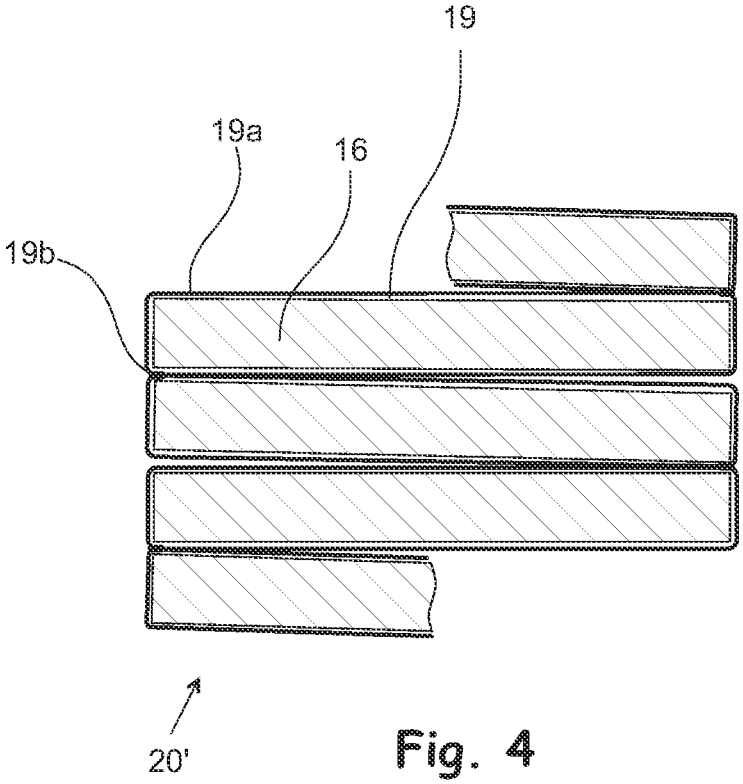
FIG. 4 is a longitudinal cross-sectional view of the heat-insulation board mat used as an heat-insulation on the roof, end walls and lateral walls of the snow storage of the above Figures, after been folded into a bundle of insulation boards in an accordion-like fashion.

The insulation materials of the roof 11, end walls 12 and 13 as well as the lateral walls 14 and 15 comprise insulation board mats 20 consisting of individual insulation boards 16, or, of groups of insulation boards put together out of several joined insulation boards 16. The individual insulation boards 16 or the insulation board groups are pivotably joined together, alternately at the upper corners and the lower corners of the transversal end edges 21 thereof. The continuous insulation board mat 20 formed thereby and comprising several insulation boards is foldable into an accordion-like insulation board bundle 20' and re-openable into a continuous insulation board mat 20 (as is shown in FIGS. 3 and 4). When the pivotably joined sections are not individual insulation boards 16 but insulation board groups consisting of multiple insulation boards 16, the insulation boards joined together in the insulation group are preferably fixed together, or inserted into a single bag or sleeve made from a suitable fabric, to hold them against each other, as a single continuous piece of board.

In the snow storage of FIG. 1, the successive insulation boards 16 are pivotably connected together by a waterproof cloth 19 (such as a PVC cloth), to form an accordion-like structure, as shown in FIGS. 3 and 4. In this case, the pivotable connection is achieved by inserting the successive insulation boards into bags made of a fabric-like material, or, into sleeves 19*a* open at two opposite ends, wherein there are several bags or sleeves one after another, joined, at an edge thereof, to each other by a suitable joint 19*b*. Thus, the insulation boards 16 inserted into the bags or sleeves 19*a* are pivotably joined together at their opposite edges, by the joints between the bags or sleeves 19*a*. In a similar embodiment of the snow storage 10, two or more insulation boards can be inserted into a single bag or sleeve 19*a*, one after another and/or side by side, the bags or sleeves 19*a* thereby pivotably connecting groups of insulation boards to each other, in the way described above.

As appears from FIG. 1, the ends and the middle portions of the heat-insulated snow pile 30 are covered with several adjacent insulation board mats 20. As for the snow storage of FIG. 1, three successive insulation board mats 20 are pulled over the snow pile 30. Two of them lie on the sides (principally at the lateral walls 14 and 15) while one of them lies on the roof 11 of the snow storage 10, on top of the snow pile 30. In another similar embodiment, there can also be one, two or more than three successive insulation board mats 20. In this case, the position of the insulation board mats 20 is generally selected case by case to restrict the entrance of rainwater into the snow pile as far as possible. In the snow storage of FIGS. 1 and 2, the entrance of rainwater is also restricted by a joint shield 24 provided on top of the snow pile. Here, it covers the midmost insulation board mats 20 as well as the joint areas between them and the first and the last insulation board mats 20. Thus, rainwater cannot enter the snow pile 30, at least not very easily, through the joints between the successive insulation board mats 20.

Figure 2:
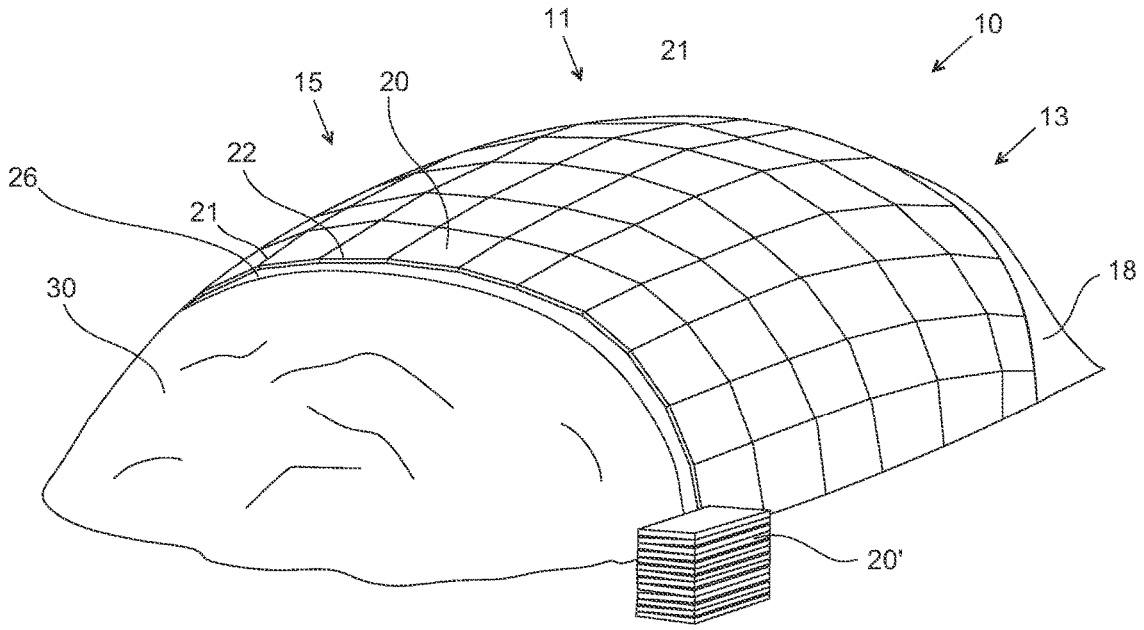
FIG. 2 is a view of the snow storage of FIG. 1, with the heat-insulators being removed from the snow pile stored over the summer.

FIG. 2 is a view of the snow storage 10 of FIG. 1, with the insulation board mats 20 and the corner inserts 18, provided in the front end 12, as seen from the direction of the Figure, and in the corners 17, respectively, removed, and with the first central insulation board mat 20 of this end face pulled off the snow pile, as the snow storage 10 is taken into use. In FIG. 2, the joint shield 24 provided on the roof of the snow storage and the joint shields 29 between the insulation board mats 20 are removed as well.

The equipment for insulating a snow pile according to the aspects of the disclosed embodiments may comprise, in addition to the variety of heat-insulating materials, a pulling device for opening up a bundle of insulation boards 20' into an insulation board mat 20 and for pulling it onto the snow pile 30. The pulling device can be an electrically or combustion engine driven winch or the like, for example, allowing each insulation board bundle 20' to be opened up and pulled onto the snow pile 30. Alternatively (especially for smaller snow storages), some or all of the insulation board bundles 20' can be opened up by manual pulling. A suitable pulling member, such a pulling rope, wire rope, strap or the like, is attached to an end of the insulation board bundle 20' and taken over the snow pile to allow the insulation board bundle 20' to be opened up and pulled onto the snow pile 30 by manually pulling at the pulling member.

When insulating a snow pile 30 made at a storage site by the method according to the aspects of the disclosed embodiments, the heat-insulation is done by using the insulation board mats 20 and the corner inserts 18 as described above as well as different kinds of other heat-insulating materials provided in the intermediate areas between the insulation board mats 20. After piling up snow, the accordion-like insulation board bundles 20' provided or brought next to the snow pile 30 are opened up into insulation board mats 20 and pulled onto the snow pile 30. As for the snow storage 10 of FIGS. 1 and 2, the accordion-like insulation board bundles 20' are provided on all sides of the snow pile 30, the insulation board bundles 20' intended for each side are situated next to this side. The location of the insulation board bundles 20' intended for the roof 11 of the snow storage 10 is selected case by case by to allow them to be pulled onto the snow pile 30 as effortlessly as possible. Before starting the pulling operation, the insulation board bundles 20' provided next to the snow pile 30 can be tilted towards the snow pile 30 to make it easier to open up them by pulling them at the topmost insulation board towards the snow pile 30. The most common way of opening up the insulation board bundles 20' of pulling them to lie on the top and the sides of the snow pile 30 is to use an electrical pulling device, such as an electrical pulling winch. The pulling winch can be a pulling winch provided on a terrain vehicle, for example, the vehicle being drivable to a suitable position with respect to the pulling direction. The insulation board bundles 20' can also be opened up manually and pulled onto the snow pile 30 by means of suitable hand-operated pulling means (such as ropes or straps) extended over the snow pile to the other side of thereof. This allows the insulation board bundles 20' intended to be installed in different locations on the top and the sides of the snow pile 30 to be conveniently moved to these desired locations by pulling at the pulling means. Often, it is also possible to use a driven pulling device for opening up and pulling the larger and heavier ones of the insulation board bundles 20' onto the snow pile 30 and to only use manual force on the smallest ones of them.

Before pulling the insulation board bundles 20' onto the snow pile 30 and after removing them from the snow pile 30, they are stored next to the snow pile 30 and laterally moved off the snow pile 30, over a required distance (aside from a trail of a ski slope, for instance). To prevent the insulation board bundles 20' from getting wet and from freezing, they are covered with a suitable, preferably waterproof sheet (such as a plastic or PVC cloth) for the duration of use of the snow of the snow storage (i.e. mostly for the entire ski season).

As for the snow storage 10 of FIGS. 1 and 2, all of the insulation board bundles 20' are situated, at the beginning of the insulation step, on the side of the snow pile 30 encompassing their intended location on top of the snow pile, prior to pulling them onto the snow pile, and, after pulling them off the snow pile 30 and re-folding them into insulation board bundles 20'. In some embodiments, it is also possible to store some of the insulation board bundles 20' on the side opposite to the side of the snow pile 30 where the rest of the insulation board bundles 20' are situated. To do this, these insulation board bundles 20' are pulled in a counter-direction with respect to the insulation board bundles 20' stored on the opposite side of said snow pile 30 as they are pulled onto the snow pile 30 or off the snow pile 30.

Figure 5:
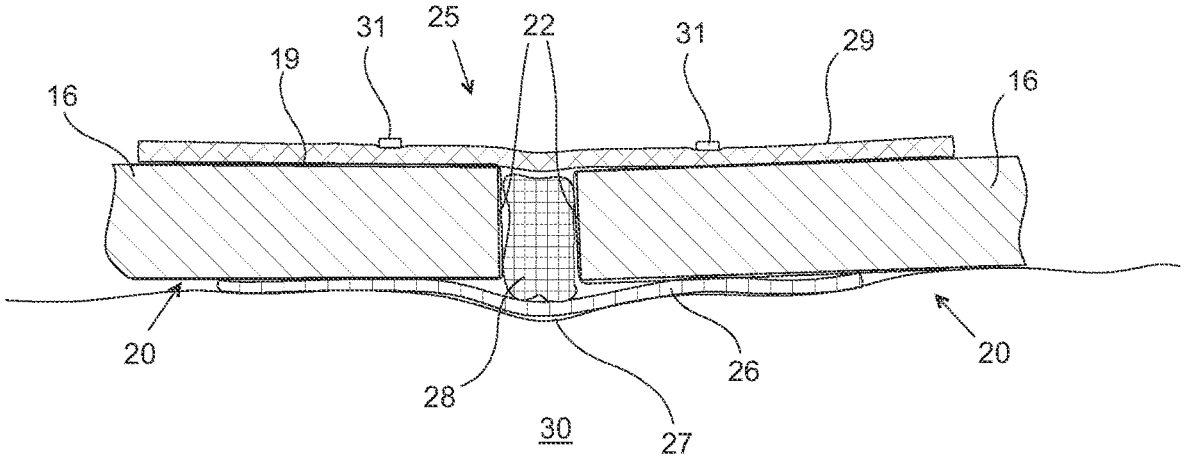
FIG. 5 is a cross-sectional view of the area between the lateral edges of the insulation board mats of the snow storage shown in FIGS. 1 and 2, taken along line A-A.

The insulation board mats are pulled to lie side by side on top of the snow pile 30 so that there are several insulation board mats 20 on top of the snow pile, with their lateral edges 22 against each other. In general, it is not necessary to attach the (longitudinal) lateral edges 22 of the adjacent insulation board mats to each other but, usually, they are just positioned (by suitably pulling by means of a winch or a hand-operated pulling device) near each other, without leaving an excessively long distance (usually under 0.5 m) between the opposite lateral edges 22. The spaces between the adjacent insulation board mats 20 are filled with an appropriate heat-insulating structure 25 consisting of heat-insulating materials 26, 28 and 29. As for the snow storage of FIG. 1, the filling is carried out, as is shown in FIG. 5, prior to pulling the insulation board mats 20 onto the snow pile 30, by providing the areas between their lateral edges with a sealing cloth 26. The sealing cloth 26 can be a single elongated piece of a waterproof fabric or plastic (a piece of PVC fabric having a thickness of approximately 0.5 to 1 m, for example) extending over the entire snow pile. It is also possible to press (by means of a suitable tool) a groove in this point of the surface of snow pile 30, the sealing cloth 26 thus forming a chute in the areas between the lateral edges 22 of the insulation board mats 20 to drain off any rainwater that has entered between the insulation board mats 20 from the snow pile 30. Thereafter, the insulation board mats 20 are pulled into place and then onto the joint area, and, if necessary, an intermediate insulation 28 (such as a foam rubber or cellular plastic insulation), with an overlying joint shield 29, such a geotextile, is provided between the lateral edges 22 of the insulation board mats 20. As an example, the joint shield 29 can be fixed on the insulation board mats by means of binding members 31 installed at the lateral regions of the insulation board mats, such as by means of tie-down straps tightened against the insulation board mats 20 (as shown in FIG. 5). This filling between the lateral edges 22 of the adjacent insulation board mats 20 provides heat-insulation and restricts the entrance of rainwater into the snow pile 30, through the spaces between the adjacent insulation board mats 20. However, in some cases, if it is desirable to attach the insulation board mats 20 to each other, it can be done with an adhesive member removably attaching to the insulation board mats, such as with adhesive tape or Velcro® fastener tapes/strips.

When several successive insulation board mats 20 are pulled onto the snow pile 30, two or more of the insulation board mats 20 pulled onto the snow pile are positioned one after another, with a first end of a first insulation board mat 20 abutting a second end of a second insulation board mat 20 and with a rear end of a third insulation board mat 20 abutting a first end of the second insulation board mat 20. If it desirable to attach the insulation board mats 20 one after another, it can be done in a way similar to the way they are attached, side by side, at their lateral edges 22, i.e. with a suitable fastener removably provided between the end edges 21 of the insulation board mats 20. It is common to use two or more successive insulation board mats 20 because the snow storage 10 is usually very large and because the use of a single insulation board mat 20 for covering the entire distance from one side of the snow pile 30 to the other side requires an insulation board mat 20 consisting of several dozens of insulation boards 16. This increases the size of the insulation board bundles 20' to an extent that their weight and dimensions can make it hard to pull them onto the snow pile 30 and off the snow pile and to carry out any other operations needed.

A finished heat-insulation of the snow storage 10 created by the method according to the aspects of the disclosed embodiments does not usually require other heat-insulating materials to be provided the insulation board layer of the insulation board mats 20. However, if it is desirable to do so, it is possible to lay an insulating cloth, such a geotextile and/or moisture shield, such as a plastic or waterproof cloth (such as a PVC cloth) over the insulation board mats. This eliminates the need of the sealing cloth 29 at the joints between the lateral edges 22 of the insulation board mats 20.

FIG. 3 is a longitudinal cross-sectional view of an insulation board mat, presenting an insulation board mat 20 having individual insulation board bundles 20' inserted into bags or sleeves 19*a* (i.e. laterally open fabric sleeves) made of waterproof fabric 19, as a structural option. Here, the waterproof cloth 19 enclosing the insulation boards 16 has joints 19*b* parallel to the transversal edges of the insulation boards and joining the overlying waterproof fabric 19 and the underlying waterproof fabric 19 of the insulation boards 20 together, welded, glued or sewed between the transversal edges of successive insulation boards 16 (i.e. edges perpendicular to the longitudinal direction of the insulation board mats 20). The joints 19*b* are positioned between the fabric layers by alternating the successive joints 19*b* at the level of the lower surface and the upper surface of the insulation boards 20. Thus, articulations transversal to the insulation boards 20 are provided therebetween, allowing the insulation board mat to be folded into an accordion-like insulation board bundle 20', as shown in FIG. 4.

Many aspects of the method and equipment according to the present disclosure can be implemented in ways deviating from the above-described exemplifying embodiments. In some cases, the insulation board mat can be a single integrated body entirely made of cellular plastic or of a similar highly heat-insulating soft and elastic insulation board material, for example. The structure of this integrated insulation board mat may comprise transversal joints or points which are more flexible than the rest of the areas, allowing the insulation board mat to be folded into an accordion-like form and re-opened up into an insulation board mat multiple times without causing damage to the structure. An insulation board mat of this type can also be inflated with air, or some other gas that has better heat-insulation properties than air, and also deflated. It is inflated once it has been opened up by pulling it onto a snow pile and deflated prior to pulling it off the snow pile and folding it into an accordion-like form. This solution has at least the advantage that it is simple and lightweight and requires less space in comparison with the solution presented above when the insulation board mats are in a folded state as insulation board bundles. Thus, the method and equipment according to the present disclosure are not restricted to the above-described exemplary embodiments but may vary within the scope of the following claims.

The invention claimed is:

1. A method of providing a snow storage with heat insulation, the method comprising covering a snow pile made at a snow storage site with heat-insulating materials of which at least some are insulation boards, wherein the insulation of the snow pile is carried out by using insulation board mats which include several insulation boards, or insulation board groups consisting of several insulation boards attached against each other, side by side and/or one after another, and which are pivotably joined together, alternately at upper corners and lower corners of their opposite transversal end edges, the resulting continuous insulation board mat composed of several insulation boards one after another being foldable into an accordion shaped insulation board bundle and re-openable into a continuous insulation board mat, as the snow pile is heat-insulated, the accordion shaped insulation board bundles are opened up and pulled to lie side by side and/or one after another on a top/sides of the snow pile, the insulation board mats which have been opened up and pulled onto the snow pile thus covering at least a portion of the snow pile, as the insulation board mats are removed from the snow storage, the insulation board mats are pulled off the snow pile and folded back into insulation board bundles with an accordion shaped configuration.

2. The method according to claim 1, wherein the insulation board bundles, after removing from the snow pile and prior to pulling onto the snow pile, are stored next to the snow pile.

3. The method according to claim 1, wherein the insulation board mats are pulled onto the snow pile to lie side by side, resulting in that several insulation board mats extend over the snow pile, with their lateral edges abutting against or spaced from each other.

4. The method according to claim 1, wherein heat-insulating materials are added to an area between lateral edges of the adjacent insulation board mats.

5. The method according to claim 1, wherein a groove is pressed in the snow below an area between lateral edges of adjacent insulation board mats and a sealing cloth extending over the snow pile is installed in the joint region to drain off any water that has entered under the insulation board mats, from between the lateral edges of the adjacent insulation board mats, from the top of the snow pile.

6. The method according to claim 1, wherein two or more successive insulation board mats are pulled onto the snow pile.

7. The method according to claim 6, wherein a joint shield is installed at least on joint seams between the successive insulation board mats lying on the top of the snow pile.

8. An equipment for providing a snow storage with heat insulation, the equipment comprising heat-insulating materials, of which at least some are insulation boards, wherein the heat-insulating materials comprise several insulation board mats which are put together out of insulation boards, or out of insulation board groups consisting of several insulation boards attached against each other, side by side and/or one after another, and wherein the individual insulation boards or the insulation board groups are pivotably joined together, alternately at upper corners and lower corners of their opposite transversal end edges, the resulting continuous insulation board mat composed of several insulation boards one after another being foldable into an accordion shaped insulation board bundle and re-openable into a continuous insulation board mat.

9. The equipment according to claim 8, wherein the successive insulation boards or insulation board groups of the insulation board mats are attached to each other by means of a fabric-like material.

10. The equipment according to claim 9, wherein the successive insulation boards or the insulation board groups of the insulation board mats are inserted into bags made of a waterproof fabric-like material, or, into sleeves open at two opposite ends, wherein there are several bags or sleeves one after another, joined, at an edge thereof, to each other, the insulation boards inserted into the bags or sleeves being pivotably joined together at their opposite end edges, by joints between the bags or sleeves.

11. The equipment according to claim 8, the equipment comprising at least one sealing cloth, intermediate insulation and/or joint shield for sealing an area between the lateral edges of two adjacent insulation board mats.

12. The equipment according to claim 8, the equipment comprising triangular corner inserts for insulating the corners between the end walls and lateral walls of the snow storage.

13. The equipment according to claim 8, the equipment comprising a joint shield for sealing a joint region between two insulation board mats installed one after another on the snow pile.

14. The method according to claim 7, wherein the joint shield comprises a geotextile or tarp.

* * * * *